US006508861B1

(12) United States Patent
Ray

(10) Patent No.: US 6,508,861 B1
(45) Date of Patent: Jan. 21, 2003

(54) INTEGRATED SINGLE-PASS DUAL-FIELD ELECTROSTATIC PRECIPITATOR AND METHOD

(75) Inventor: Isaac Ray, Brooklyn, NY (US)

(73) Assignee: Croll Reynolds Clean Air Technologies, Inc., Westfield, NJ (US)

( * ) Notice: Subject to any disclaimer, the term of this patent is extended or adjusted under 35 U.S.C. 154(b) by 0 days.

(21) Appl. No.: 10/032,759

(22) Filed: Oct. 26, 2001

(51) Int. Cl.[7] ..... B03C 3/12

(52) U.S. Cl. ..... 95/79; 55/DIG. 38; 96/28; 96/53; 96/76; 96/77; 96/82; 95/66; 95/73; 95/75

(58) Field of Search ..... 95/79, 66, 73, 95/71, 75; 96/75–80, 82, 97, 52, 53, 64, 28; 55/DIG. 38

(56) References Cited

U.S. PATENT DOCUMENTS 1,250,088 A * 12/1917 Burns ..... 95/75
1,343,285 A * 6/1920 Schmidt ..... 96/76 X
1,357,202 A * 10/1920 Nesbit ..... 96/75
2,505,907 A * 5/1950 Meston ..... 96/97
3,483,671 A 12/1969 Wiemer ..... 96/75
3,747,299 A * 7/1973 Chiang ..... 95/79
4,146,371 A * 3/1979 Melcher et al. ..... 96/77 X
4,259,093 A * 3/1981 Vlastos et al. ..... 96/76
4,305,909 A * 12/1981 Willett et al. ..... 96/53 X
5,039,318 A 8/1991 Johansson ..... 96/74
5,254,155 A * 10/1993 Mensi ..... 96/53 X
5,766,319 A * 6/1998 Kogelschatz ..... 96/76 X
6,004,376 A * 12/1999 Frank ..... 95/79
6,110,256 A 8/2000 Reynolds et al. ..... 95/4
6,193,782 B1 * 2/2001 Ray ..... 95/73 X
6,294,003 B1 * 9/2001 Ray ..... 55/DIG. 38

* cited by examiner

*Primary Examiner*—Richard L. Chiesa
(74) *Attorney, Agent, or Firm*—Arthur Jacob

(57) ABSTRACT

An improvement in an electrostatic precipitator and method for removing particulate contaminants entrained in a gas stream passed through an electrode arrangement in which particulates are charged in a first electrostatic field and subjected to a second electrostatic field to be removed and collected for further disposition. The electrode arrangement includes a charging section having a charging electrode and a field electrode, and a collecting section having a repelling electrode and a collecting electrode. The field electrode and the collecting electrode are integrated, providing a relatively compact construction, and the charging electrode and the repelling electrode are electrically separated by high voltage diodes in a single power supply arrangement such that the charging section and the collecting section each are provided with a corresponding electrostatic field operated at an optimum voltage and current for respectively charging and collecting particulate contaminants entrained in the gas stream.

28 Claims, 4 Drawing Sheets

INTEGRATED SINGLE-PASS DUAL-FIELD ELECTROSTATIC PRECIPITATOR AND METHOD

The present invention relates generally to the removal of particulate contaminants from commercial and industrial exhaust gases and pertains, more specifically, to an improvement in the construction and operation of electrostatic precipitators for attaining greater efficiency and effectiveness in removing such contaminants from a gas stream passed through an electrostatic precipitator, and especially from gas streams comprising high density mists and fumes containing submicron sized particles and droplets.

Electrostatic precipitators have been in use for a very long time in accomplishing the removal of particulates from gas streams. The principles which form the basis for the operation of electrostatic precipitators are well-known: Particulates entrained within a gas stream are subjected to an ionizing, or discharge voltage upon passing through an electrostatic field and are thereby charged so that the charged particulates will migrate, under the influence of the electrostatic field, in a direction generally perpendicular to the direction of flow of the gas stream, to be separated from the gas stream for collection and disposal. Among electrostatic precipitators in common use are single-stage devices in which an operating voltage is applied between a charging electrode and a collector electrode. The charging electrode charges the particulates in the gas stream and the operating voltage between the charging electrode and the collector electrode imparts a migration velocity to the charged particulates, causing the particulates to migrate toward the collector electrode for separation from the gas stream. Since separation efficiency is directly related to the magnitude of the migration velocity of the particulates, and the magnitude of the migration velocity is directly proportional to operating voltage, it becomes important to maintain the operating voltage as high as possible.

Typically, the particulates are charged by ionization induced between the charging electrode and the collector electrode, the ionization being facilitated by utilizing sharp points, provided by thin wires or pointed needle-like projections along the charging electrode. High operating current becomes essential in order to supply sufficient charge to the particulates and effect removal with efficiency. However, operating voltage is limited by the voltage at which a discharge occurs between the charging electrode and the collector electrode, commonly referred to as "sparkover" voltage, thereby limiting not only the operating voltage, but the operating current as well. This is true especially where the gas stream comprises a high density mist or fumes of submicron sized particles or droplets, all of which can reduce the voltage at which sparkover occurs.

Operating voltage can be increased considerably through the elimination of sharp-pointed projections so that the charging electrode is provided with a relatively smooth external surface; however, such a smooth surface reduces current flow and, consequently, reduces the charge supplied to the particulates, with the result that particulates no longer can be removed efficiently.

Past proposals for dealing with these conflicting requirements for high operating current, on the one hand, to achieve effective charging of particulates to be removed from a gas stream, and high operating voltage, on the other hand, to attain effective migration velocities for efficient removal of the charged particulates, have resulted in multiple-pass systems requiring relatively large and expensive installations.

The present invention provides an improvement which accomplishes the desired high operating current, for charging particulates, and high operating voltage, for separating and removing the charged particulates, in a simplified integrated single-pass electrostatic precipitator. As such, the present invention attains several objects and advantages, some of which are summarized as follows: Provides an integrated, relatively compact electrostatic precipitator and method for accomplishing increased effectiveness and efficiency in separating particulate contaminants from commercial and industrial exhaust gas streams; attains effective and efficient separation of particulates from gas streams such as high density mists and fumes containing submicron sized particles or droplets in a single electrostatic precipitator unit; provides a desired high operating current in a first electrostatic field for charging particulates, and a desired high operating voltage in a second electrostatic field for imparting migration velocity to the charged particulates to effect efficient separation of the particulates from a stream of gas passed through a single electrostatic precipitator; enables increased effectiveness and efficiency in the operation of an electrostatic precipitator, especially in dealing with particulates entrained in high density mists or fumes containing submicron sized particles or droplets; allows the construction of an electrostatic precipitator, and especially a condensing wet electrostatic precipitator, with increased economy and with more compact dimensions; enables the use of a single source of high voltage power in providing high operating current to a charging section of an integrated electrostatic precipitator, and high operating voltage to a collecting section of the integrated electrostatic precipitator for economy and efficiency in separating particulates from a gas stream passed through the integrated electrostatic precipitator; provides a wet electrostatic precipitator and, in particular, a condensing wet electrostatic precipitator, with a construction which utilizes relatively inexpensive corrosion-resistant materials, such as synthetic polymeric materials, for effective operation in connection with exhaust gases containing corrosive constituents; facilitates the attainment of condensation in a condensing wet electrostatic precipitator without the requirement for relatively heavy cooling structures ordinarily associated with condensing wet electrostatic precipitators; provides long-term, reliable operation in electrostatic precipitators effective in separating particulate contaminants from commercial and industrial exhaust streams and, in particular, exhaust streams which include high density mists or fumes of submicron sized particles or droplets.

The above objects and advantages, as well as further objects and advantages, are attained by the present invention which may be described briefly as an improvement in an electrostatic precipitator for removing particulate contaminants entrained in a stream of gas by passing the stream of gas in a downstream direction through an electrode arrangement in which the particulate contaminants are charged and subjected to an electrostatic field to be removed from the stream of gas and collected for further disposition, the improvement comprising: a charging section in the electrode arrangement for charging the particulate contaminants as the stream of gas passes through the electrode arrangement; a collecting section in the electrode arrangement located downstream from the charging section for collecting particulate contaminants charged in the charging section; the charging section including at least one charging electrode and a corresponding field electrode for charging the particulate contaminants; the collecting section including at least one collecting electrode for collecting charged particulate contaminants and a corresponding repelling electrode for driving the charged particulate contaminants toward the collecting electrode, the repelling electrode and the charging electrode being electrically separated from one another, and the collecting electrode being integral with the field electrode and located downstream of the field electrode such that the charging section and the collecting section comprise an integrated compact structure; a charging power source for providing a charging voltage and a charging current to the charging electrode; and a collecting power source for providing a collecting voltage to the repelling electrode at a voltage higher than the charging voltage and a current lower than the charging current, such that the charging section and the collecting section each are provided with a corresponding electrostatic field operating at an optimum voltage and current for respectively charging and collecting particulate contaminants entrained in the stream of gas.

In addition, the present invention provides an improvement in a method for removing particulate contaminants entrained in a stream of gas by passing the stream of gas in a downstream direction through an electrostatic precipitator having an electrode arrangement in which the particulate contaminants are charged and subjected to an electrostatic field to be removed from the stream of gas and collected for further disposition, the improvement comprising: charging the particulate contaminants in a charging section having at least one charging electrode and a corresponding field electrode as the stream of gas passes through the electrode arrangement; collecting, in a collecting section having at least one collecting electrode, charged particulate contaminants charged in the charging section and driven toward the collecting electrode by a repelling electrode; integrating the collecting electrode with the field electrode such that the charging section and the collecting section comprise an integrated compact structure; and electrically separating the repelling electrode from the charging electrode so as to enable: providing a charging voltage and a charging current to the charging electrode; and providing a collecting voltage to the repelling electrode at a voltage higher than the charging voltage and a current lower than the charging current, such that the charging section and the collecting section each are provided with a corresponding electrostatic field operating at an optimum voltage and current for respectively charging and collecting particulate contaminants entrained in the stream of gas.

The invention will be understood more fully, while still further objects and advantages will become apparent, in the following detailed description of preferred embodiments of the invention illustrated in the accompanying drawing, in which.

Figure 1:
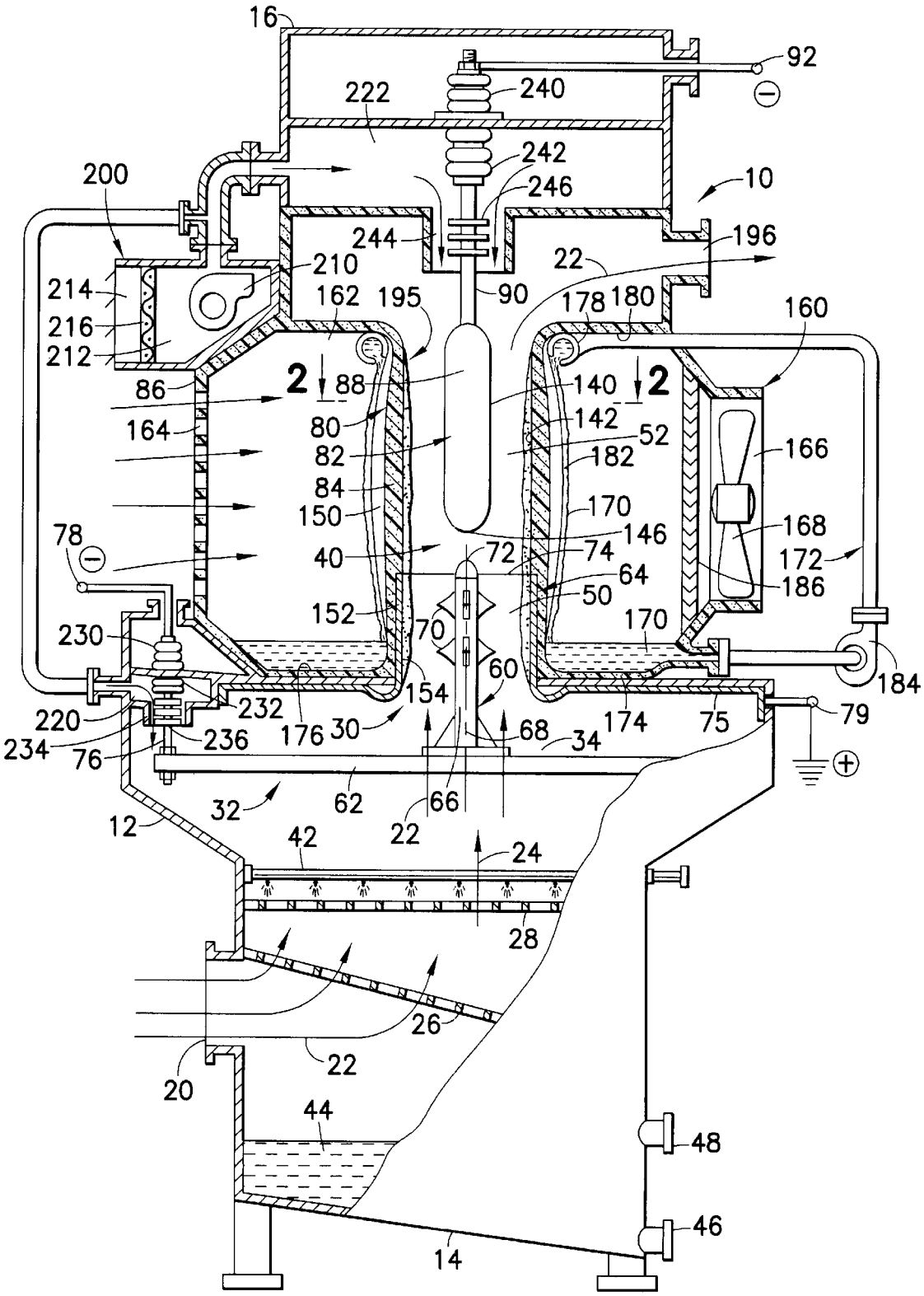
FIG. 1 is a partially diagrammatic, longitudinal cross-sectional view of an apparatus employing improvements of the present invention.
Figures 2, 3:
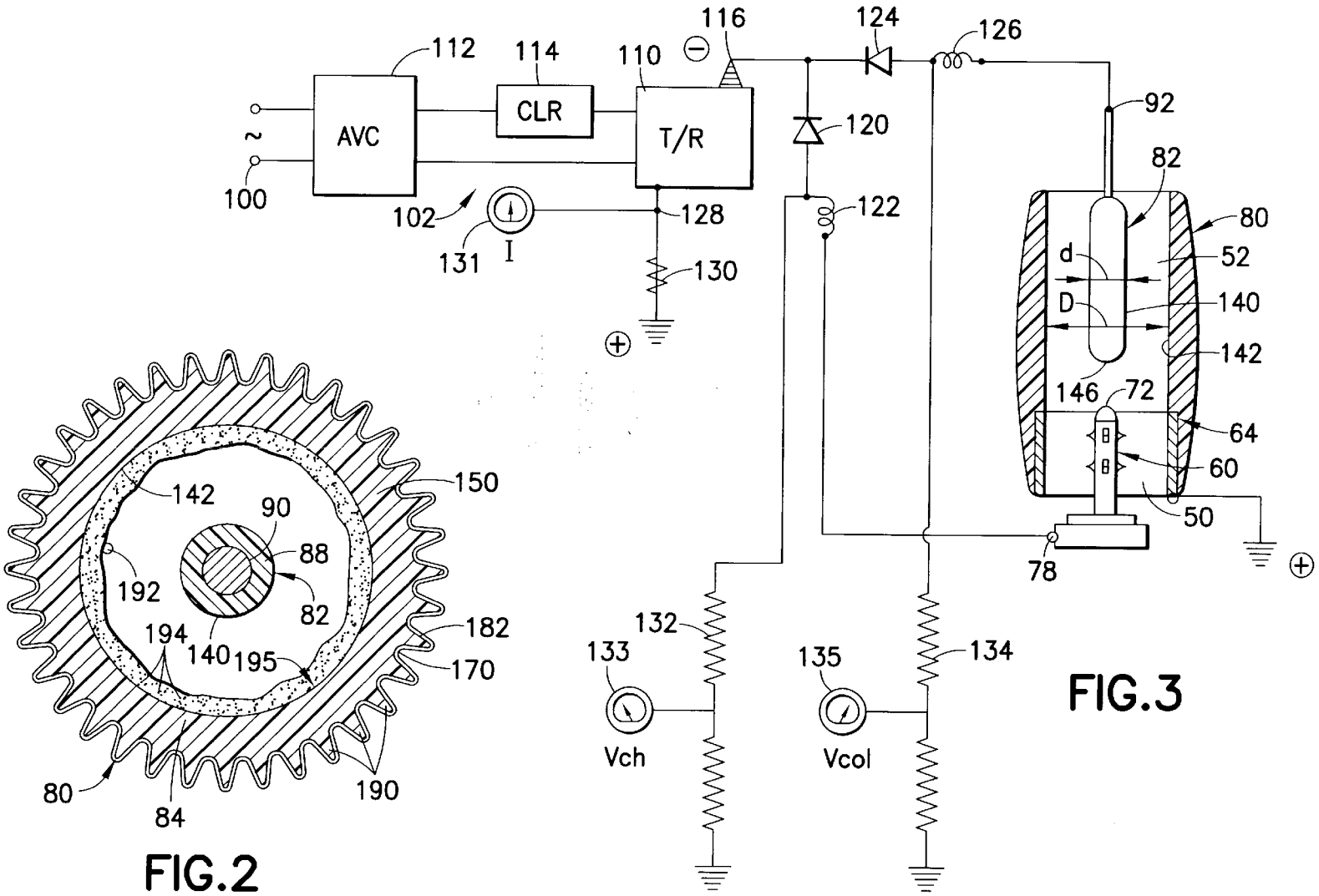
FIG. 2 is an enlarged fragmentary cross-sectional view taken along line 2—2 of FIG. 1.
FIG. 3 is a schematic illustration of features of the improvement of the present invention.

Referring now to the drawing, and especially to FIGS. 1 and 2 thereof, an apparatus employing improvements of the present invention is illustrated generally at 10 and is seen to have a housing 12 which extends vertically from a lower bottom end 14 to an upper top end 16. An inlet is shown in the form of a port 20 located adjacent the bottom end 14 and receives an incoming gas stream, as indicated by arrows 22, laden with moisture and with contaminants to be removed from the stream. In this instance, the gas stream 22 includes particulate contaminants entrained in the stream and can comprise a high density of mist or fumes of submicron sized particles or droplets, commonly found in commercial and industrial exhausts. The incoming gas stream 22 is directed upwardly along a vertical path of travel 24 to pass through baffles 26 and 28 and toward an electrode assembly 30 of a condensing wet electrostatic precipitator 32.

Precipitator 32 includes an inlet area 34 extending transversely across the electrode assembly 30, and the electrode assembly includes a plurality of electrode arrangements, one of which electrode arrangements is illustrated at 40, placed in a matrix extending across the inlet area 34 in a manner now well-known in the construction of condensing wet electrostatic precipitators. The baffles 26 and 28 distribute the incoming gas stream 22 essentially evenly throughout the inlet area 34, and a spray header 42 located immediately above the baffle 28 continuously irrigates the baffles 26 and 28, during operation of the apparatus 10, in order to remove accumulations of larger particles drawn from the gas stream 22 and to provide additional clean liquid mist to the precipitator 32. Liquid and sludge are collected in a reservoir 44 adjacent the bottom end 14 of the housing 12 and are drained through a drain 46, with any excess drawn off through an overflow outlet 48.

As in current electrostatic precipitators, the gas stream 22, as it travels downstream along the path of travel 24 in the direction from the bottom end 14 toward the top end 16, passes through the electrode assembly 30 where particulate contaminants entrained in the gas stream 22 are charged and subjected to an electrostatic field to be removed from the gas stream 22 and collected for further disposition. In the improvement of the present invention, each electrode arrangement 40 includes an ionizing, or charging section 50 for charging the particulate contaminants as the gas stream 22 passes through a first electrostatic field established in the electrode arrangement 40, and a collecting section 52 located downstream from the charging section 50 for separating the particulate contaminants charged in the charging section 50 and collecting the separated particulates in a second electrostatic field established in the electrode arrangement 40.

The charging section 50 includes an ionizing, or charging electrode 60 supported upon a bus frame 62 and extending upwardly into a corresponding field electrode 64. Charging electrode 60 is shown in the form of a rigid post 66 extending axially upwardly along a central axis 68 and having a plurality of sharp-pointed spikes 70 located along the length of the post 66 and extending radially toward the field electrode 64. Charging electrode 60 terminates at an upper end 72. The field electrode 64 is illustrated in the form of a circular cylindrical tubular member 74 coaxial with the post 66 along central axis 68, and includes a radial flange 75. A support member 76 supports bus frame 62 and serves as a conductor between the bus frame 62 and a high voltage terminal 78. The field electrode 64 is connected to ground at 79. In the preferred construction, both the charging electrode 60 and the field electrode 64 are constructed of a corrosion-resistant alloy, such as Hastelloy C-276, so as to resist attack by corrosive constituents in the gas stream 22 and the deteriorating effects of ionization within the charging section 50.

The collecting section 52 includes a collecting electrode 80 and a corresponding repelling electrode 82. Collecting electrode 80 is shown in the form of a cylindrical tubular portion 84 of a sub-section 86 of housing 12, the tubular portion 84 extending along central axis 68, downstream of the field electrode 64. Repelling electrode 82 is illustrated in the form of a cylindrical member 88 extending coaxial with the tubular portion 84, along central axis 68, and supported by a suspension rod 90 so as to be spaced axially from the upper end 72 of the charging electrode 60. Rod 90 serves as a conductor between the repelling electrode 82 and a high voltage terminal 92. In the preferred construction, both the collecting electrode 80 and the repelling electrode 82 are constructed of a corrosion-resistant material, the illustrated material being a synthetic polymeric material such as fiberglass reinforced polyester or reinforced polyvinylchloride (PVC), so as to resist attack by corrosive constituents in the gas stream 22, and including graphite powder to render the material electrically conductive.

Turning now to FIG. 3, as well as to FIGS. 1 and 2, a charging voltage is supplied to the charging electrode 60 at terminal 78, and a collecting voltage is supplied to the repelling electrode 82 at terminal 92. In the preferred arrangement illustrated in FIG. 3, the power source for charging voltage and the power source for collecting voltage are provided by a common high voltage source so as to enable added economy. Thus, a line source of power 100 of alternating current is connected to a single high voltage power supply 102 having a transformer/rectifier (T/R) 110, an automatic voltage controller (AVC) 112 and a current limiting reactor (CLR) 114. The negative output 116 from T/R 110 is coupled to the charging electrode 60 through a first high voltage diode 120 and a first reactor 122, and is coupled to the repelling electrode 82 through a second high voltage diode 124 and a second reactor 126. The positive output 128 of T/R 110 is connected to ground, through a shunt 130 which determines current flow I, as indicated at 131.

Figure 4A:
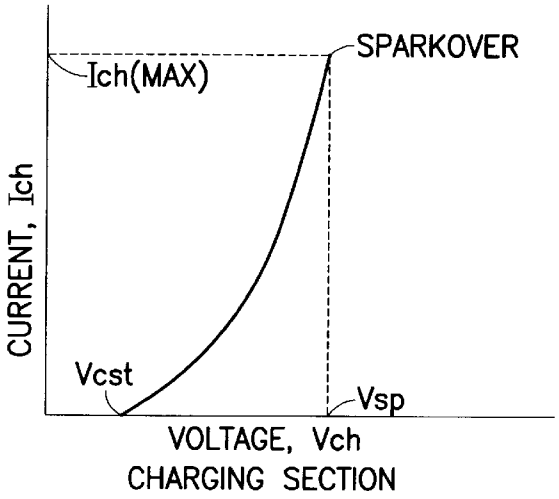
FIGS. 4A and 4B are graphic representations depicting operating current versus operating voltage in sections of the apparatus.
Figure 4B:
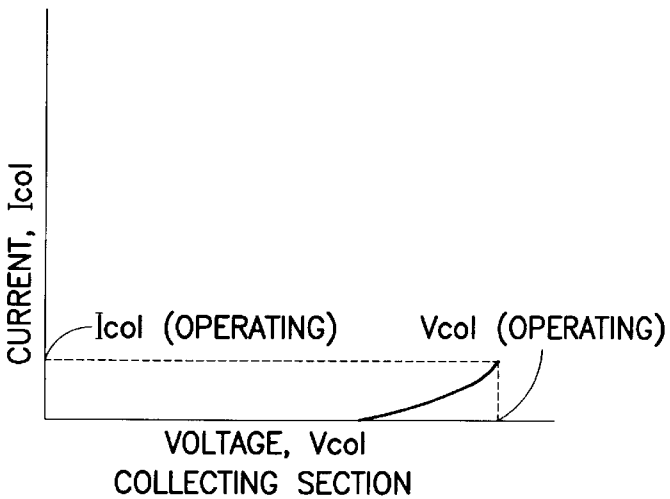
Figure 5:
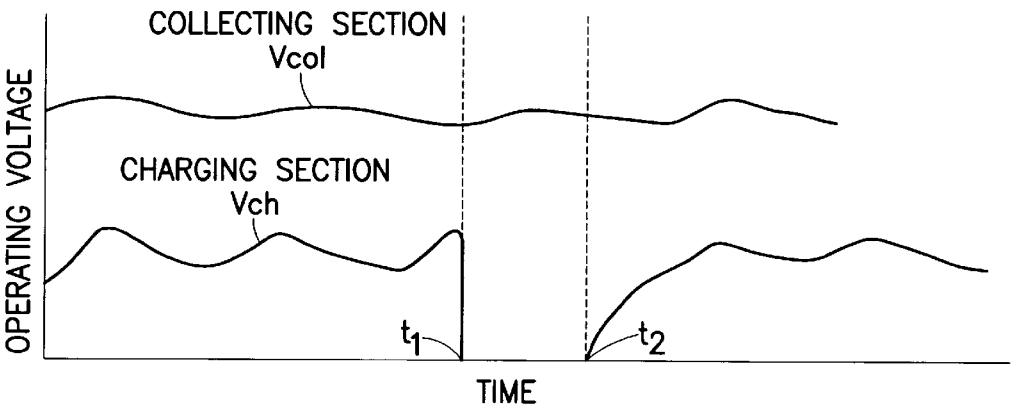
FIG. 5 is a graphic representation depicting operating voltages versus time in sections of the apparatus.

The operating voltage in the charging section 50 is determined by a first voltage divider 132, as indicated at 133, and is illustrated in FIG. 4A as voltage $V_{ch}$established between charging electrode 60 and field electrode 64. The operating voltage in the collecting section 52 is determined by a second voltage divider 134, as indicated at 135, and is illustrated in FIG. 4B as voltage $V_{col}$ established between repelling electrode 82 and collecting electrode 80. As depicted in FIG. 4A, when the voltage in the charging section 50 reaches a corona starting voltage $V_{cst}$, current flow $I_{ch}$ will increase exponentially until the voltage reaches a sparkover voltage $V_{sp}$, at which point AVC 112 will discontinue the supply of high voltage, for a time interval $t_2-t_1$, as illustrated in FIG. 5, which time interval is just long enough to discontinue and extinguish sparking. The high voltage diode 124 enables the operating voltage in collecting section 52 to remain unchanged, as depicted by $V_{col}$ in FIG. 5. The current flow $I_{ch}$ in the charging section 50 reaches a maximum high current flow, as determined by the shunt 130, as depicted in FIG. 4A, while the current flow $I_{col}$ in the collecting section 52 remains relatively low, as depicted in FIG. 4B.

Repelling electrode 82 and collecting electrode 80 of the collecting section 52 have essentially smooth confronting surfaces 140 and 142, respectively. The surfaces 140 and 142 are rendered electrically conductive, by the employment of electrically conductive synthetic polymeric materials in the construction of the electrodes 80 and 82, and assisted by moisture formed on the surfaces 140 and 142 during operation of the apparatus 10. By selecting a ratio between the diameter D of the collecting electrode 80 and the diameter d of the repelling electrode 82, in concert with the smooth surfaces 140 and 142, the voltage at which corona could start in the collecting section 52 will be substantially higher than the operating voltage $V_{col}$, thereby precluding the occurrence of a corona discharge in the collecting section 52 while enabling operation of the collecting section 52 at a higher operating voltage $V_{col}$, and a lower current flow $I_{col}$, relative to the operating voltage $V_{ch}$ and current flow $I_{ch}$ in the charging section 50.

A comparison of the operating voltages $V_{ch}$ in the charging section 50 and $V_{col}$ in the collecting section 52 is depicted in FIG. 5. It will be seen that the operating voltage $V_{col}$ remains essentially at the same high level and remains continuous independent of variations in the operating voltage $V_{ch}$. Thus, the electrical separation between the charging section 50 and the collecting section 52 and, more specifically, the electrical separation of the charging electrode 60 from the repelling electrode 82 attained by the utilization of diodes 120 and 124, as well as the spacing between the charging electrode 60 and the repelling electrode 82, enables each of the charging section 50 and the collecting section 52 to be provided with an optimum operating voltage and current, independent of one another, for accomplishing charging of particulates in a first electrostatic field established in the charging section 50 with a relatively lower voltage and higher current flow, and separation and collection of particulates in the collecting section 52 with a relatively higher voltage and lower current flow. To this end, it is noted that the semi-spherical contours at the spaced apart confronting ends 72 and 146,. respectively, of the charging electrode 60 and the repelling electrode 82 tend to inhibit any discharge of high voltage between the electrodes 60 and 82. Higher separation and collection efficiency is attained by maintaining a relatively high operating voltage continuously in the collecting section 52, despite corona discharges and concomitant lower voltages and interruptions due to sparkover in the charging section 50, as compared to conventional wet electrostatic precipitators in which operating voltage is limited by corona discharge and remains at the same lower voltage for both the charging of particulates and for separating and collecting the charged particulates. Field measurements have indicated that the operating voltage $V_{col}$ in the collecting section 52 can be as much as approximately three times the operating voltage $V_{ch}$ in the charging section 50, thereby imparting a migration velocity to the charged particulates in the collecting section 52 which is at least about three times higher than migration velocities attained in conventional wet electrostatic precipitators. Moreover, the provision of a continuous high operating voltage in the collecting section 52, even during the time interval during which voltage is discontinued in the charging section 50 as a result of sparkover, attains a dramatic increase in effectiveness and efficiency in the separation and collection of particulates. The increased effectiveness and efficiency of the described dual-field operation is attained without an increase in the dimensions of the wet electrostatic precipitator, thereby conserving installation space, and with only a minimal difference in construction costs.

Returning now to FIGS. 1 and 2, as described above, the construction of condensing wet electrostatic precipitator 32 incorporates less expensive corrosion-resistant materials, such as synthetic polymeric materials, in the electrode arrangement 40. The integration of the charging section 50 and the collecting section 52 into a single structure having a continuous wall 150 extending along both the charging section 50 and the collecting section 52, while maintaining electrical separation, enables a relatively compact and economical construction. Thus, use of a more expensive corrosion-resistant alloy is confined to the charging section 50, where operating conditions, including the presence of corona discharges, also known as sparks and arcs, require such materials in order to withstand the effects of such operating conditions. The use of less expensive corrosion-resistant materials, such as synthetic polymeric materials, is enabled in the collecting section 52 where operating conditions and, in particular, the absence of corona discharge, allow such materials to perform reliably. In a further measure to conserve expense, the relatively costly alloy material of field electrode 64 is provided in the form of an insert 152 affixed to and thereby integrated with the less costly synthetic polymeric material of wall 150, thereby further reducing the cost of constructing the integrated electrode arrangement 40. Insert 152 includes an inner surface 154 confronting charging electrode 60.

In order to condense moisture carried by the gas stream 22 upon inner collector surface 142 of wall 150, as is a characteristic of a condensing wet electrostatic precipitator, wall 150 is cooled by a cooling system 160. Unlike most cooling systems in conventional condensing wet electrostatic precipitators, wherein a relatively heavy cooling jacket, filled with a cooling medium such as water, is placed around the matrix which comprises the electrode assemblies, condensing wet electrostatic precipitator 32 utilizes a much lighter-weight cooling system 160, better suited to the structural strength of the material used in the construction of the matrix of electrode arrangements 40. Thus, cooling system 160 includes a cooling chamber 162, shown molded of a synthetic polymeric material within sub-section 86 of housing 12, the cooling chamber 162 having an inlet 164 for ambient air, and an outlet 166. Ambient air is drawn through inlet 164 and across the electrode arrangements 40 by a variable speed fan 168, and is exhausted at outlet 166. At the same time, a cooling liquid, such as water 170, is circulated through a liquid circuit 172 from a pan 174 at the bottom 176 of the cooling chamber 162 to a distributor 178 at the top 180 of the cooling chamber 162, where the water 170 is sprayed onto outer surface 182 of wall 150, under the influence of a circulating pump 184. The water 170 runs down along the surface 182 of wall 150 and, in concert with the flow of ambient air across the outer surface 182, cools the wall 150. A mist eliminator 186 prevents water droplets from escaping through outlet 166.

As seen in FIG. 1, the outer surface 182 of wall 150 is provided with a convex curved contour configuration in vertical planes so that the water 170, while running down along surface 182, will tend to follow the surface 182 without separation and effectively cool the wall 150. As best seen in FIG. 2, the outer surface 182 is provided with a plurality of radial fins 190 in order to enhance heat transfer. The cooled wall 150 attains condensation along the inner collector surface 142, without the necessity for a relatively heavy, liquid filled cooling jacket. Particulates charged in the charging section 50 pass into the collecting section 52 where the charged particulates are separated from the gas stream 22 and driven toward the collecting electrode 80. As in a conventional condensing wet electrostatic precipitator, condensation 192 along the inner surface 142 of wall 150, formed from water vapor in the saturated gas stream 22, carries away the collected particulates 194 for further disposition. By virtue of the integration of charging section 50 and collecting section 52 and, in particular, the field electrode 64 and the collecting electrode 80, inner surfaces 142 and 154 comprise corresponding portions of an inner surface 195 which extends essentially continuously along the length of the continuous wall 150, thereby enhancing the ability of the condensation 192 to run down along the inner surface 195 and flush away the collected particulates 194. The gas stream 22, now free of the collected particulates 194, is exhausted at an outlet 196 adjacent the top end 16 of housing 12.

An air purge system 200 includes a blower 210 which draws ambient air into an air purge chamber 212, through an inlet 214 and a filter assembly 216, and distributes the air to purging plenums 220 and 222. An insulator 230 which couples support member 76 and bus frame 62 with housing 12 includes a lower portion 232 exposed to the gas stream 22. The lower portion 232 is placed within plenum 220 so that the air distributed to the plenum 220 and passing through passage 234 protects the lower portion 232 against contamination by particulates and moisture carried by gas stream 22. Additional protection against contamination is provided by the placement of a relatively short electrostatic precipitator section 236 in the passage 234. Likewise, an insulator 240 which couples suspension rod 90 with housing 12 includes a lower portion 242 placed within plenum 222 for protection against contamination, by virtue of the passing of air through passage 244, and a short electrostatic precipitator section 246 provides additional protection.

Figure 6:
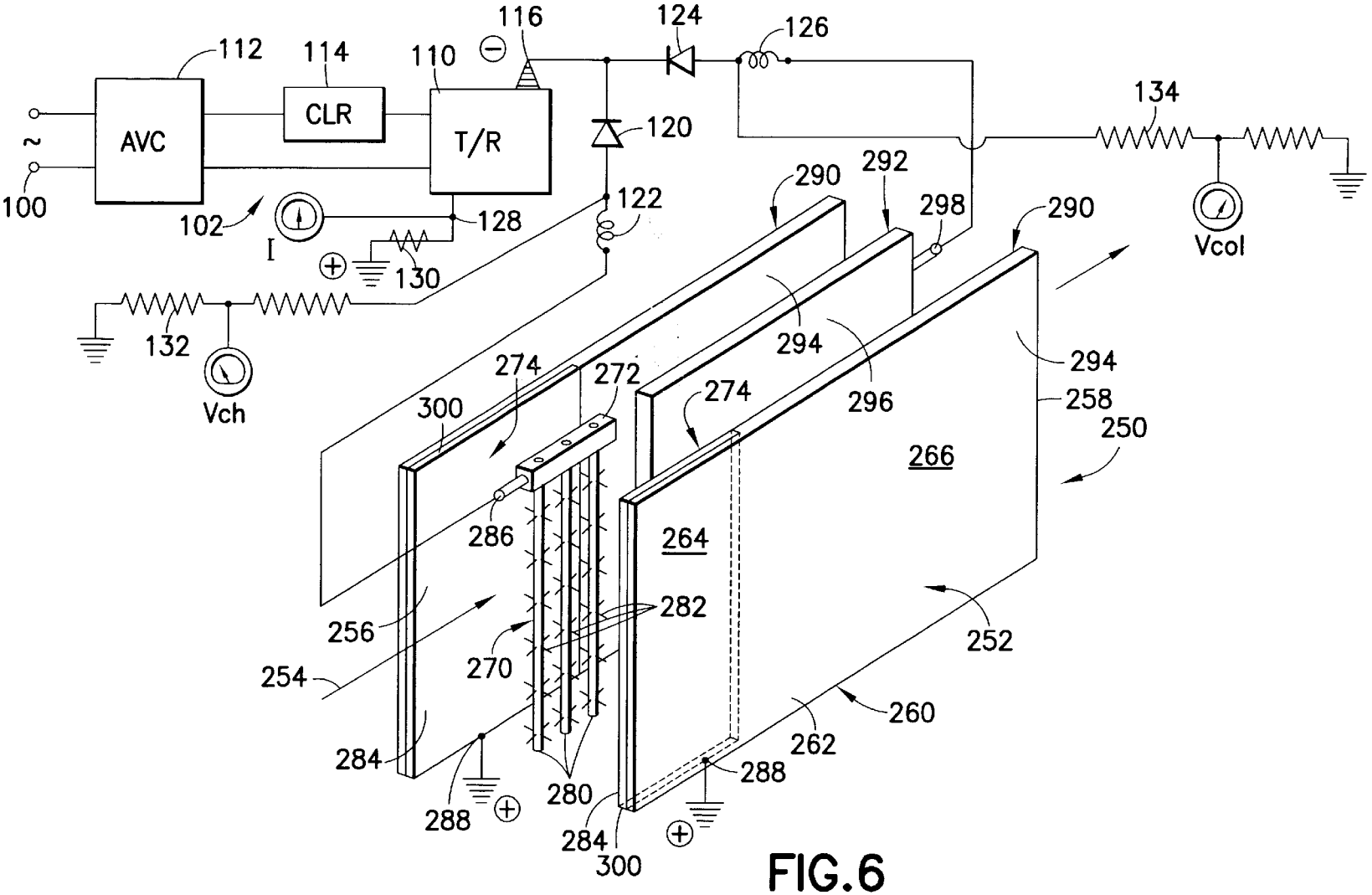
FIG. 6 is a diagrammatic perspective view of another apparatus incorporating improvements of the present invention.

Referring now to FIG. 6, an alternate apparatus which incorporates the improvement of the present invention is illustrated at 250 and is seen to include an electrostatic precipitator 252 which receives a contaminant laden gas stream 254 at an inlet end 256 and passes the gas stream 254 in a downstream direction to an outlet end 258. An electrode assembly 260 includes an electrode arrangement 262 having a charging section 264 integrated with a collecting section 266 placed downstream of the charging section 264. The charging section 264 includes an ionizing, or charging electrode 270 supported upon a bus frame 272 and extending transversely into a corresponding field electrode 274. Charging electrode 270 is shown in the form of posts 280 extending transversely and having a plurality of sharp-pointed projections 282 located along the length of each post 280 and extending radially from the posts 280. The field electrode 274 is illustrated in the form of opposed plates 284 spaced from the charging electrode 270. Bus frame 272 carries a high voltage terminal 286. The field electrode 274 is connected to ground at 288. In the preferred construction, both the charging electrode 270 and the field electrode 274 are constructed of a corrosion-resistant alloy, such as Hastelloy C-276.

The collecting section 266 includes a collecting electrode 290 and a corresponding repelling electrode 292. Collecting electrode 290 is shown in the form of opposed plates 294 spaced from repelling electrode 292 and located downstream of the field electrode 274. Repelling electrode 292 is illustrated in the form of a plate 296 placed between the plates 294 of the collecting electrode 290 and having a high voltage terminal 298. In the preferred construction, both the collecting electrode 290 and the repelling electrode 292 are constructed of a corrosion-resistant material, the illustrated material being an electrically conductive synthetic polymeric material such as a conducting fiberglass reinforced polyester or a conducting reinforced polyvinylchloride (PVC). In order to conserve construction cost, the relatively expensive alloy of the plates 284 of field electrode 274 is provided in the form of cladding 300 integrated with the less expensive synthetic polymeric sheet material of the plates 294.

A charging voltage is supplied to the charging electrode 270 at terminal 286, and a collecting voltage is supplied to the repelling electrode 292 at terminal 298. As in the apparatus described above in connection with FIG. 3, line source of power 100 of alternating current is connected to single high voltage power supply 102 including transformer/rectifier (T/R) 110, automatic voltage controller (AVC) 112 and current limiting reactor (CLR) 114. The negative output 116 from T/R 110 is connected to the charging electrode 270 through first high voltage diode 120 and first reactor 122, and is connected to the repelling electrode 292 through second high voltage diode 124 and second reactor 126. The positive output 120 of T/R 110 is connected to ground, through a shunt 130. Operation of the charging section 264 and the collecting section 266 with respective dual electrostatic fields thus is similar to that described above in connection with FIGS. 4A, 4B and 5.

It will be seen that the improvement of the present invention attains all of the objects and advantages summarized above, namely:

Provides an integrated, relatively compact electrostatic precipitator and method for accomplishing increased effectiveness and efficiency in separating particulate contaminants from commercial and industrial exhaust gas streams; attains effective and efficient separation of particulates from gas streams such as high density mists and fumes containing submicron sized particles or droplets in a single electrostatic precipitator unit; provides a desired high operating current in a first electrostatic field for charging particulates, and a desired high operating voltage in a second electrostatic field for imparting migration velocity to the charged particulates to effect efficient separation of the particulates from a stream of gas passed through a single electrostatic precipitator; enables increased effectiveness and efficiency in the operation of an electrostatic precipitator, especially in dealing with particulates entrained in high density mists or fumes containing submicron sized particles or droplets; allows the construction of an electrostatic precipitator, and especially a condensing wet electrostatic precipitator, with increased economy and with more compact dimensions; enables the use of a single source of high voltage power in providing high operating current to a charging section of an integrated electrostatic precipitator, and high operating voltage to a collecting section of the integrated electrostatic precipitator for economy and efficiency in separating particulates from a gas stream passed through the integrated electrostatic precipitator; provides a wet electrostatic precipitator and, in particular, a condensing wet electrostatic precipitator, with a construction which utilizes relatively inexpensive corrosion-resistant materials, such as synthetic polymeric materials, for effective operation in connection with exhaust gases containing corrosive constituents; facilitates the attainment of condensation in a condensing wet electrostatic precipitator without the requirement for relatively heavy cooling structures ordinarily associated with condensing wet electrostatic precipitators; provides long-term, reliable operation in electrostatic precipitators effective in separating particulate contaminants from commercial and industrial exhaust streams and, in particular, exhaust streams which include high density mists or fumes of submicron sized particles or droplets.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. An improvement in an electrostatic precipitator for removing particulate contaminants entrained in a stream of gas by passing the stream of gas in a downstream direction through an electrode arrangement in which the particulate contaminants are charged and subjected to an electrostatic field to be removed from the stream of gas and collected for further disposition, the improvement comprising:

a charging section in the electrode arrangement for charging the particulate contaminants as the stream of gas passes through the electrode arrangement;

a collecting section in the electrode arrangement located downstream from the charging section for collecting particulate contaminants charged in the charging section;

the charging section including at least one charging electrode and a corresponding field electrode for charging the particulate contaminants;

the collecting section including at least one collecting electrode for collecting charged particulate contaminants and a corresponding repelling electrode for driving the charged particulate contaminants toward the collecting electrode, the repelling electrode and the charging electrode being electrically separated from one another, and the collecting electrode being integral with the field electrode and located downstream of the field electrode such that the charging section and the collecting section comprise an integrated compact structure;

a charging power source for providing a charging voltage and a charging current to the charging electrode; and a collecting power source for providing a collecting voltage to the repelling electrode at a voltage higher than the charging voltage and a current lower than the charging current, such that the charging section and the collecting section each are provided with a corresponding electrostatic field operating at an optimum voltage and current for respectively charging and collecting particulate contaminants entrained in the stream of gas.

2. The improvement of claim 1 wherein the collecting electrode is constructed of a synthetic polymeric material.

3. The improvement of claim 2 wherein the synthetic polymeric material comprises an electrically conductive synthetic polymeric material.

4. The improvement of claim 1 wherein the repelling electrode is constructed of a synthetic polymeric material.

5. The improvement of claim 4 wherein the synthetic polymeric material comprises an electrically conductive synthetic polymeric material.

6. The improvement of claim 1 wherein the charging power source and the collecting power source include a common high voltage source, and a coupling arrangement couples the high voltage source to the charging electrode and to the repelling electrode for establishing the charging voltage and the collecting voltage independent of one another.

7. The improvement of claim 6 wherein the coupling arrangement includes a first diode and a first voltage selector between the high voltage source and the charging electrode, and a second diode and a second voltage selector between the high voltage source and the repelling electrode.

8. The improvement of claim 7 wherein the collecting electrode is constructed of a synthetic polymeric material.

9. The improvement of claim 8 wherein the synthetic polymeric material comprises an electrically conductive synthetic polymeric material.

10. The improvement of claim 6 wherein the repelling electrode is constructed of a synthetic polymeric material.

11. The improvement of claim 10 wherein the synthetic polymeric material comprises an electrically conductive synthetic polymeric material.

12. The improvement of claim 1 wherein the collecting electrode includes a first tubular wall extending axially along an axis aligned with the downstream direction, and the field electrode includes a second tubular wall extending along the axis, integral with the first tubular wall upstream of the collecting section.

13. The improvement of claim 12 wherein the first and second tubular walls include corresponding inner surface portions respectively confronting the repelling electrode and the charging electrode, the corresponding inner surface portions comprising an inner surface extending essentially continuously along the collecting section and the charging section.

14. The improvement of claim 13 wherein the axis extends in a vertical direction, and the collecting section is located vertically above the charging section.

15. An improvement in a condensing wet electrostatic precipitator for removing particulate contaminants entrained in a stream of gas by passing the stream of gas in a downstream direction through an electrode arrangement in which the particulate contaminants are charged and subjected to an electrostatic field to be removed from the stream of gas and collected for further disposition, the improvement comprising:

a charging section in the electrode arrangement for charging the particulate contaminants as the stream of gas passes through the electrode arrangement;

a collecting section in the electrode arrangement located downstream from the charging section for collecting particulate contaminants charged in the charging section;

the charging section including at least one charging electrode and a corresponding field electrode for charging the particulate contaminants;

the collecting section including at least one collecting electrode for collecting charged particulate contaminants and a corresponding repelling electrode for driving the charged particulate contaminants toward the collecting electrode, the repelling electrode and the charging electrode being electrically separated from one another, and the collecting electrode being integral with the field electrode and located downstream of the field electrode such that the charging section and the collecting section comprise an integrated compact structure;

a charging power source for providing a charging voltage and a charging current to the charging electrode;

a collecting power source for providing a collecting voltage to the repelling electrode at a voltage higher than the charging voltage and a current lower than the charging current, such that the charging section and the collecting section each are provided with a corresponding electrostatic field operating at an optimum voltage for respectively charging and collecting particulate contaminants entrained in the stream of gas;

the collecting electrode having an inner collector surface confronting the repelling electrode, and an opposite outer surface; and a cooling arrangement for passing ambient air over the outer surface to cool the collector surface and condense water vapor carried by the stream of gas to form condensate on the collector surface.

16. The improvement of claim 15 wherein the cooling arrangement includes a liquid circuit for circulating a cooling liquid along the outer surface of the collecting electrode.

17. The improvement of claim 15 wherein the collecting electrode is constructed of a synthetic polymeric material.

18. The improvement of claim 17 wherein the synthetic polymeric material comprises an electrically conductive synthetic polymeric material.

19. The improvement of claim 15 wherein the repelling electrode is constructed of a synthetic polymeric material.

20. The improvement of claim 19 wherein the synthetic polymeric material comprises an electrically conductive synthetic polymeric material.

21. The improvement of claim 20 wherein the collecting electrode includes a first tubular wall extending axially along an axis aligned with the downstream direction and having a first inner surface portion, and the field electrode includes a second tubular wall extending along the axis integral with the first tubular wall upstream of the collecting section and having a second inner surface portion, the first and second inner surface portions comprising an inner surface extending essentially continuously along the collecting section and the charging section.

22. The improvement of claim 15 wherein the charging power source and the collecting power source include a common high voltage source, and a coupling arrangement couples the high voltage source to the charging electrode and to the repelling electrode for establishing the charging voltage and the collecting voltage independent of one another.

23. The improvement of claim 22 wherein the coupling arrangement includes a first diode and a first voltage selector between the high voltage source and the charging electrode, and a second diode and a second voltage selector between the high voltage source and the repelling electrode.

24. The improvement of claim 22 wherein the collecting electrode is constructed of a synthetic polymeric material.

25. The improvement of claim 24 wherein the synthetic polymeric material comprises an electrically conductive synthetic polymeric material.

26. The improvement of claim 22 wherein the repelling electrode is constructed of a synthetic polymeric material.

27. The improvement of claim 26 wherein the synthetic polymeric material comprises an electrically conductive synthetic polymeric material.

28. An improvement in a method for removing particulate contaminants entrained in a stream of gas by passing the stream of gas in a downstream direction through an electrostatic precipitator having an electrode arrangement in which the particulate contaminants are charged and subjected to an electrostatic field to be removed from the stream of gas and collected for further disposition, the improvement comprising:

charging the particulate contaminants in a charging section having at least one charging electrode and a corresponding field electrode as the stream of gas passes through the electrode arrangement;

collecting, in a collecting section having at least one collecting electrode, charged particulate contaminants charged in the charging section and driven toward the collecting electrode by a repelling electrode;

integrating the collecting electrode with the field electrode such that the charging section and the collecting section comprise an integrated compact structure; and electrically separating the repelling electrode from the charging electrode so as to enable:

providing a charging voltage and a charging current to the charging electrode; and providing a collecting voltage to the repelling electrode at a voltage higher than the charging voltage and a current lower than the charging current, such that the charging section and the collecting section each are provided with a corresponding electrostatic field operating at an optimum voltage and current for respectively charging and collecting particulate contaminants entrained in the stream of gas.

* * * * *